United States Patent [19]

Rice

[11] 4,091,934

[45] May 30, 1978

[54] SWIVEL MOUNTED PUMP WITH INTEGRAL VALVE MEANS

[75] Inventor: Roy E. Rice, Uhrichsville, Ohio

[73] Assignee: Ruger Equipment, Inc., Uhrichsville, Ohio

[21] Appl. No.: 783,829

[22] Filed: Apr. 1, 1977

[51] Int. Cl.[2] ..... B66C 23/00

[52] U.S. Cl. ..... 212/8 R; 212/58 R; 214/132; 60/477

[58] Field of Search ..... 214/130 R, 149, 132; 212/8 R, 35 R, 58 R; 60/477, 479, 481, 482

[56] References Cited

U.S. PATENT DOCUMENTS

| | | | |
|---|---|---|---|
| 2,700,483 | 1/1955 | Cook et al. | 214/149 |
| 3,275,296 | 9/1966 | Meyer | 212/8 R |
| 3,848,749 | 11/1974 | Anderson et al. | 214/DIG. 10 X |

*Primary Examiner*—Edgar W. Geoghegan

*Attorney, Agent, or Firm*—Mahoney & Stebens

[57] ABSTRACT

A swivel mounted pump apparatus for a mine crane is provided having an integral fluid-flow control valve incorporated in the swivel mounting structure. The pump mechanism is a hand operated fluid pump which is mounted on an upright supporting spindle for selective swiveling movement to a desired operating position. Fluid interconnection of the pump mechanism to a fluid reservoir and actuating ram of the associated apparatus is achieved through internal passageways formed in the supporting spindle to permit operator control of fluid flow through the system. This valve may be selectively operated to enable either actuation of the ram by the mechanism or a reverse fluid flow in the system and to also provide protection to the apparatus from excessive fluid pressures that may build up through incorrect or improper use of the associated ram mechanism.

18 Claims, 6 Drawing Figures

SWIVEL MOUNTED PUMP WITH INTEGRAL VALVE MEANS

BACKGROUND OF THE INVENTION

A fluid pump apparatus of this invention is intended primarily for utilization in conjunction with hoist or crane devices which are of a relatively small capacity and physical size and intended for manual operation. Specifically, the hoist apparatus may be of the type generally employed in mining operations where the clearances and vertical elevations, as well as lateral clearances, are substantially restricted and it is not possible to utilize the electric powered equipment due to the presence of hazardous atmosphere.

An example of such hoist apparatus is illustrated in previously issued U.S. Pat. No. 2,700,483 granted to K. L. Cook, et al, on Jan. 25, 1955. That patent illustrates a hoist or crane which is specifically designed for use in mining operations and includes a hydraulic ram for actuating the crane arm or beam. Motive power for actuation of the hydraulic ram is obtained from a manually operated pump mechanism which incorporates a fluid control valve and interconnecting flexible conduits.

While the apparatus for obtaining the motive fluid power, as shown in the previously issued patent, is fully functional to effect operation of the mine crane, the apparatus itself presents additional problems that detract from the optimum utilization of the equipment. In particular, the illustrated apparatus presents a considerable degree of inconvenience as to operation in that the operator must position himself with respect to a particular location relative to the vertical post or standard of the hoist in order to operate the pump. As a consequence, the operator of the crane may find himself placed in an awkward position in order to effectively manipulate the pump operating handle and thus may endanger himself or other personnel attending to the lifting or hoisting operation.

Attempts to eliminate the problems associated with the mechanism illustrated in the noted patent have been made but such attempts have not proven entirely successful. For example, the pump means itself has been mounted on a hinged apparatus connected to a portion of the hoist structure and may then be pivoted to a more advantageous or desired position. A structure of this type is disclosed in U.S. Pat. No. 3,848,749 issued to Anderson et al on Nov. 19, 1974. The hoist apparatus disclosed in that patent includes a cylinder and piston pump unit that is carried on a horizontal arm or bracket which is pivoted to the hoist mast. The pump is provided with an actuating handle and with the pivoted support, may be swung to a more advantageous operating position. While the pump in that patented structure may be pivoted to a more convenient location, the structure nevertheless does not provide the optimum convenience of operation and also requires use of relatively long flexible conduits or hoses for interconnection of the pump with the ram actuating mechanism. The long hoses interfere with operations and a further hazard is presented with these conduits being exposed and very susceptible to mechanical injury.

SUMMARY OF THE INVENTION

In accordance with this invention, a particularly novel pump apparatus is provided for utilization with a hoist device such as a mine crane wherein the pump is of a hand operated type and readily positionable for convenience of operator actuation. This novel type apparatus includes a manual or hand actuated pump device which is mounted on an upright support spindle and is revolvable about the vertical axis of the spindle to a desired operating position. Fluid interconnection with a crane beam actuating ram and a fluid reservoir is accomplished by conduits which interconnect with the pump through the support spindle. Passageways are formed in the support spindle and communicate with inlet and outlet ports of the pump device. To effect the objective of enabling the pump to swivel about the support spindle, suitable fluid interconnections and passageways are provided wherein the fluid may pass to or from the spindle with respect to the pump by means of connecting or mounting rings that are journalled on the spindle.

To further enhance the operating characteristics and operator convenience, the apparatus of this invention also incorporates a manually actuated control valve mechanism in the support spindle. This advantageous mounting of the valve results in a very compact arrangement of components and convenient location of the valve operating mechanism.

This configuration and arrangement of components provides several substantial advantages in a structure of this nature designed for utilization with the indicated hoist mechanisms. One important advantage is the effective elimination of the flexible hoses or other conduits that would otherwise be present on the outside of the structural frame members of the crane. Elimination of such hoses or conduits avoids the abuse and damage to which exposed hoses would otherwise be subjected. Also, elimination of interconnecting hoses attached to the pump readily enables the pump to be swiveled through an angle of 180° or more without resulting interference between the hoses and the hoist or crane frame. Incorporation of the fluid control valve directly into the support structure on which the pump is mounted for swiveling movement, further enhances the convenience of operation through location of the control valve actuating means in a readily accessible location from the operator's standpoint.

These and other objects and advantages of this invention will be readily apparent from the following detailed description of an illustrative embodiment thereof and the accompanying drawings.

DESCRIPTION OF THE DRAWING FIGURES

DETAILED DESCRIPTION OF THE ILLUSTRATIVE EMBODIMENT

Figure 1:
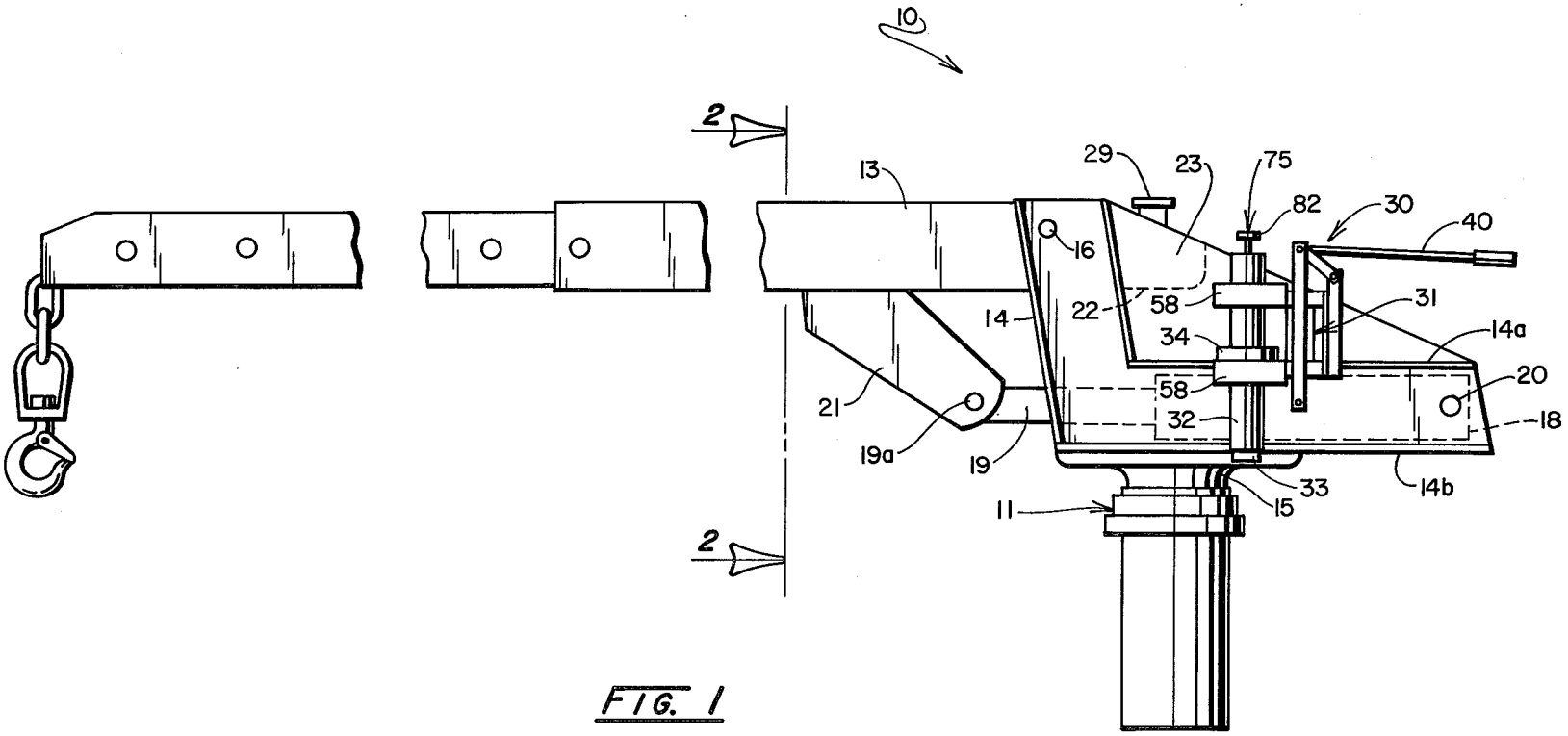
FIG. 1 is a side-elevational view of a crane provided with a pump apparatus embodying this invention.
Figure 2:
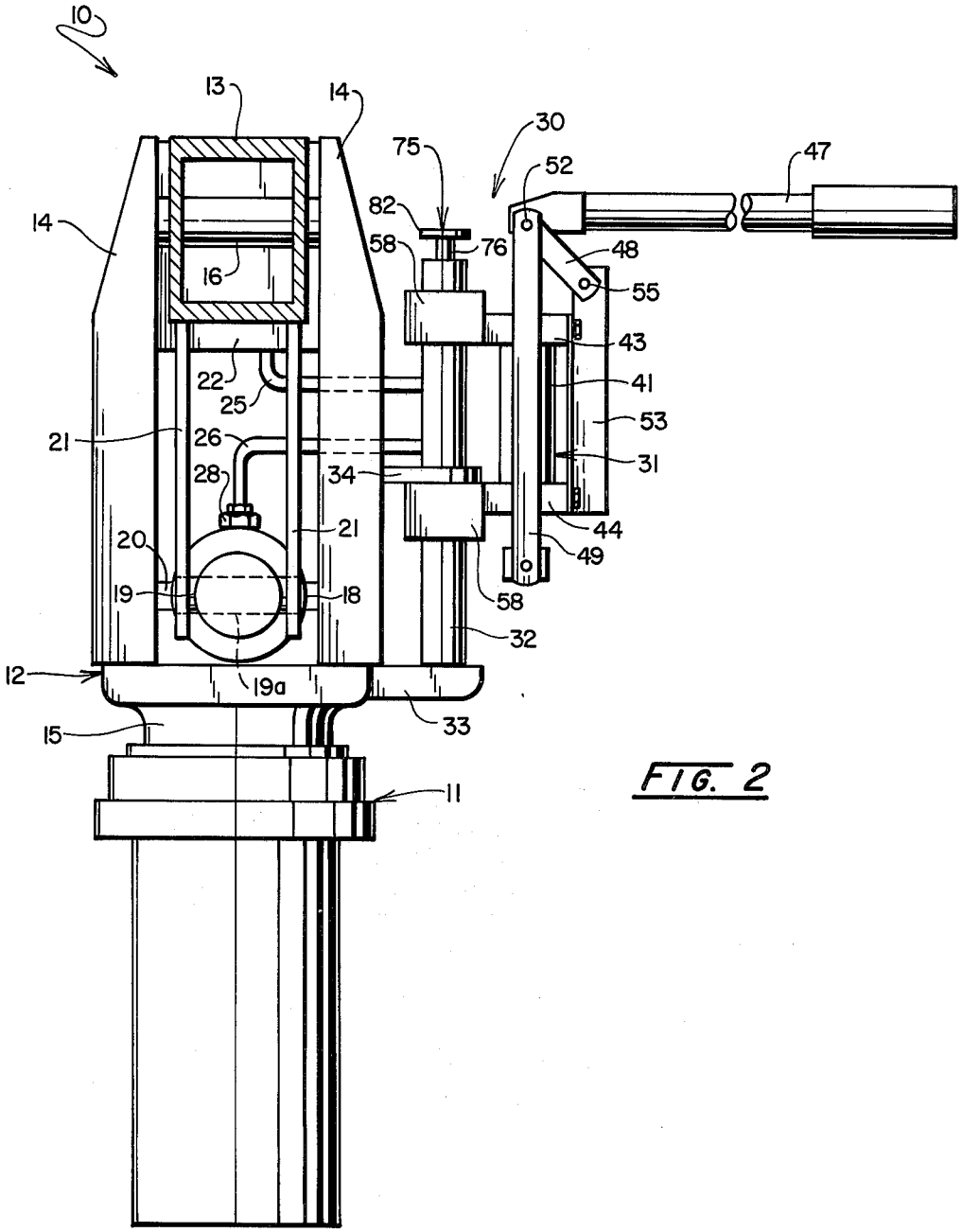
FIG. 2 is a vertical sectional view on an enlarged scale taken along line 2—2 of FIG. 1.
Figure 3:
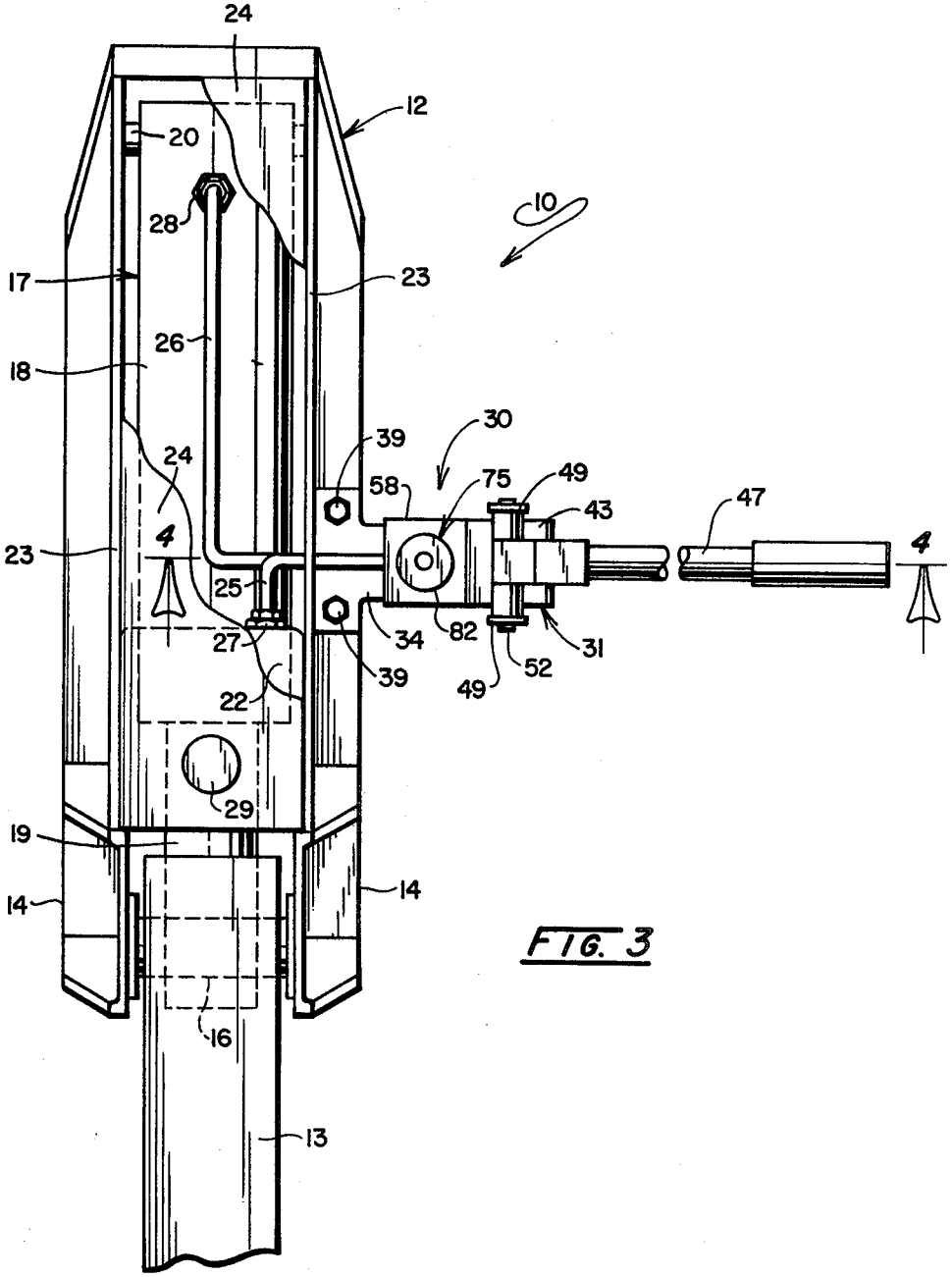
FIG. 3 is a fragmentary top plan view of the crane on an enlarged scale.

Having reference to the drawings, there is shown in FIGS. 1, 2 and 3 a basic structural arrangement for a mine crane to which the pump apparatus of this invention is speficially adapted. The mine crane is designated generally by the numeral 10 and includes a support mounting 11, a base frame 12 and an elongated crane beam 13. The base frame 12 includes a pair of channel members 14 configured in a general L-shape and rigidly secured to each other and to a support post 15 which is disposed in the support mounting 11 for rotation about a vertical axis for uninterrupted swiveling of the crane through a full circle. The crane beam 13 is journalled on a horizontal axle 16 carried at the upper end of the vertically extending legs of the channel members 14.

Actuation of the crane beam for pivoting movement in a vertical plane is effected by a hydraulic ram 17 which includes a cylinder 18 and extendable piston rod 19. The cylinder 18 is disposed between and pivotally secured at one end between the horizontally extending legs of the two channel members 14 by a pivot pin 20 and projects forwardly in a substantially horizontal plane. The forwardly projecting piston rod 19 is pivoted by a pivot pin 19*a* to a pair of spaced parallel bracket plates 21 which are secured to the crane beam and project vertically downward therefrom. Application of pressurized fluid to the cylinder 18 effects extension or retraction of the piston road 19 and accomplishes elevation or depression of the crane beam 13.

A hydraulic fluid reservoir 22 is carried by the base frame 12 and comprises a tank which is supported by the channel members 14. For protective purposes, the reservoir tank 22 is enclosed within vertically disposed side plates 23 which are welded to the respective channels members in the included angle of the two legs. A top cover plate 24 welded to the upper edges of the side plates aids in providing substantial protection for the interconnecting fluid conduits 25 and 26 which project outwardly through one of the side plates 23 for interconnection with the pumping apparatus. Each of these conduits 25 and 26 which may be flexible, is connected to the reservoir tank 22 and ram cylinder 18 by the respective connector fittings 27 and 28. An externally extending filler spout with closure cap 29 may be provided for the reservoir tank 22.

Figure 4:
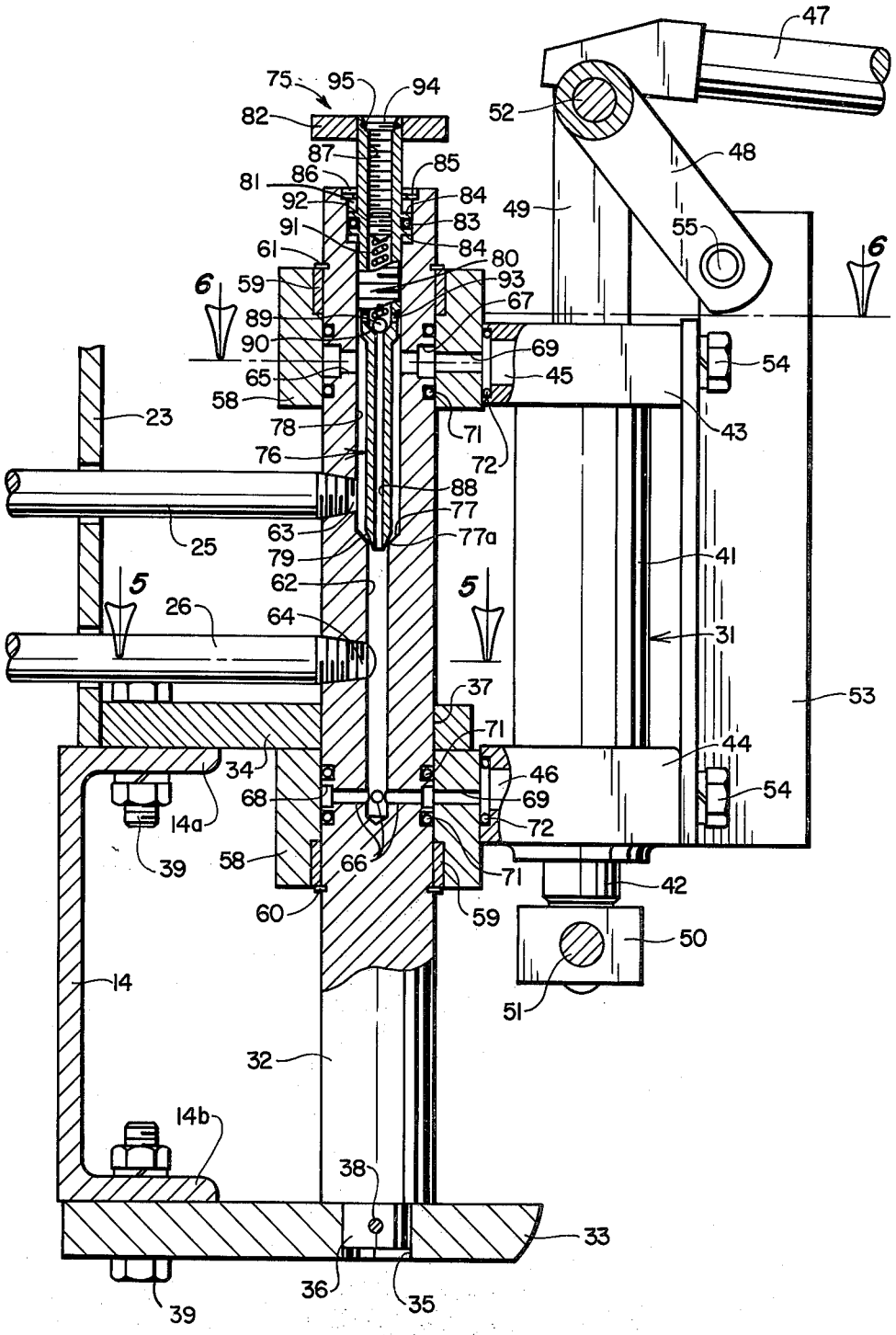
FIG. 4 is a fragmentary vertical sectional view on an enlarged scale taken along line 4—4 of FIG. 3.
Figure 5:
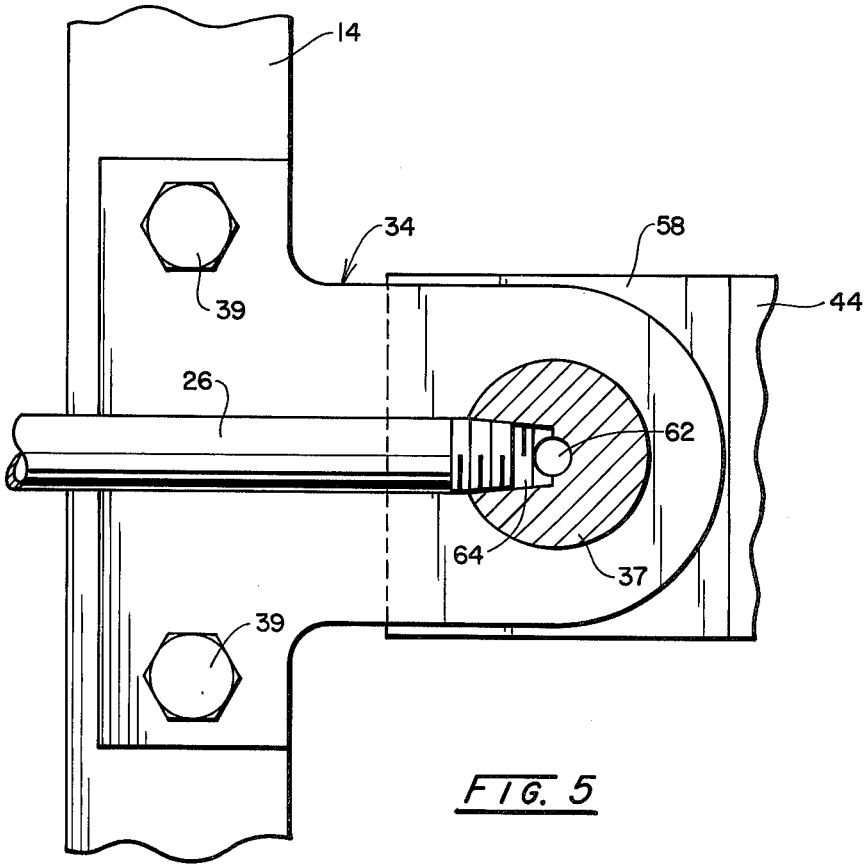
FIG. 5 is a fragmentary horizontal sectional view taken along line 5—5 of FIG. 4.

The pump apparatus provided by this invention is indicated generally by the numeral 30 and is mounted on one of the channel members 14 at the side of the base frame 12. The pump apparatus includes a manually operated fluid pump 31 which is mounted on a support spindle 32 for swiveling movement about the vertical or longitudinal axis of the spindle. The spindle 32 is mechanically connected with the base frame 12 by a supporting framework which includes a lower support bracket 33 and an upper connecting bracket 34. These brackets 33 and 34 are secured to flanges 14*a*, 14*b* of the one channel member 14 and project laterally outwardly from the base frame 12. As shown in FIG. 4, a socket 35 is formed in the lower support bracket 33 into which projects an axle pin 36 that is integrally formed in axially downwardly projecting relationship to the support spindle 32. The upper connecting bracket 34, as can be best seen in FIG. 5, includes an aperture 37 through which the main body of the support spindle extends. Preferably, the support spindle 32 is fixed by means of a pin 38 to the lower support bracket to prevent relative rotation of the spindle with respect to its supporting framework. A pair of bolt-type fasteners 39, as can be seen in FIGS. 3 and 5, are utilized to secure the upper bracket 34 to the upper flange 14*a* of the horizontally extending section of the one channel 14. Similar bolt-type fasteners 39 are provided to secure the lower bracket 33 to the lower flange 14*b* of the horizontal portion of the channel member 14.

Specific mounting of the pump 31 and interconnection with the respective fluid conduits 25 and 26 is best illustrated in FIG. 4. The pump 31 is of a well known type comprising an elongated cylinder 41 from which a piston rod 42 extends downwardly and carries a piston (not shown) for axial movement in the cylinder. The cylinder 41 is vertically oriented in spaced parallel relationship to the support spindle 32 with the upper and lower ends respectively provided with end caps 43 and 44. Each of the end caps 43 and 44 is provided with respective fluid receiving and discharge passageways 45 and 46. These passageways communicate with the interior of the cylinder 41 in the well known manner of such devices whereby axial reciprocation of the piston rod 42 in cooperation with the automatic operation of directional flow control valves (not shown) will effect a displacement of fluid from the receiving passageway 45 and out through the discharge passageway 46. This pump may advantageously be of the double-acting type to effect displacement of fluid upon movement of the piston in either direction.

Axial reciprocation of the piston rod 42 is effected by means of an elongated handle 47 pivoted on a fulcrum arm 48 and coupled with the piston rod by parallel link arms 49. The parallel link arms 49 extend downwardly along the exterior sides of the cylinder 41 and are pivotally connected to the piston rod by a connector block 50 by means of a pivot pin 51. The connector block 50 is secured to the lower end of the piston rod with the links 49 journalled on an axle 52 extending through the interconnection of the fulcrum arm 48 and handle 47. Support of the handle, fulcrum arm and link arms 49, is accomplished by means of angle brackets 53 which are secured to the end caps 43 and 44 by connector bolts 54. A pivot pin 55 extends through the upper ends of the brackets 53 and supports the fulcrum arm 48 for swinging movement in a vertical plane. This mechanism thus results in axial reciprocation of the piston rod 42 through swinging of the handle 47 in a vertical plane.

Figure 6:
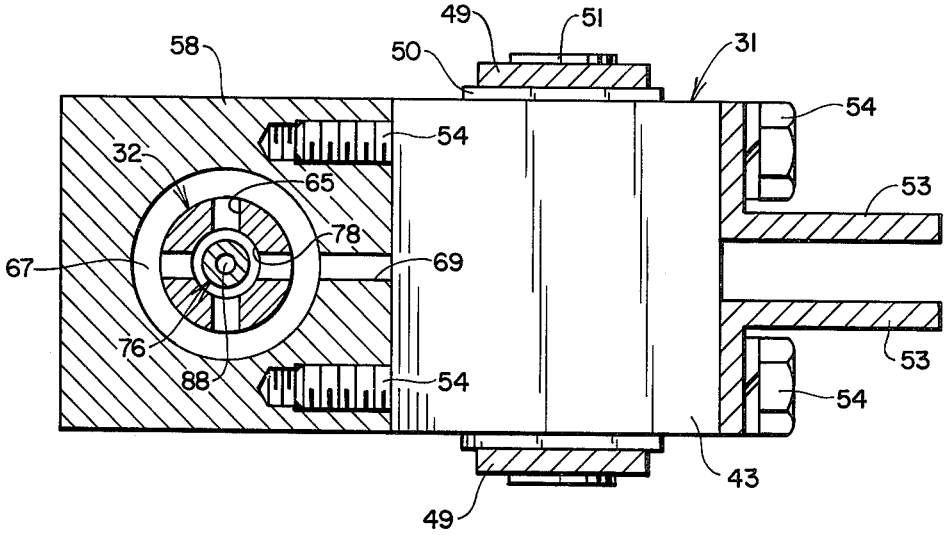
FIG. 6 is a fragmentary horizontal sectional view taken along line 6—6 of FIG. 4.

Mounting of the pump 31 on the support spindle 32 is effected by rotary fluid coupling means including a pair of mounting blocks 58 which are journalled on the spindle in axially spaced relationship. Each of the mounting blocks 58 preferably incorporates a suitable bearing element 59 which may advantageously be of the roller or pin type. Each of the mounting blocks 58 is secured to a respective end cap, 43 or 44, of the cylinder 41 by means of connector bolts 54. These connector bolts 54 extend through the end caps and are threaded into respective sockets formed in the mounting block 58 with this interconnection best seen in FIG. 6. With the respective mounting blocks 58 secured to the pump cylinder 41, it will be seen that the blocks are maintained in fixed axial relationship and are located vertically on the spindle 32 to place the lower block immediately below the upper support bracket 34. A spring type retaining ring 60 is preferably positioned immediately below the bearing 59 of the lower block 58 and provides the necessary vertical support to maintain the pump 31 at the illustrated position on the support spindle. A similar retaining ring 61 is positioned on spindle 32 immediately above the uppermost mounting block 58 and completes the mounting of the pump 31 and its associated mounting blocks 58 on the spindle.

In accordance with this invention, hydraulic fluid flow between the fluid conduits 25 and 26 and the pump 31 is effected by fluid passageways formed in the support spindle 32 and connecting with the several elements. These passageways include an elongated passageway 62 centrally formed in the spindle and extending axially therethrough into co-extensive relationship with the respective pump mounting blocks 58. The two fluid conduits 25 and 26 have terminal end portions which are adapted to be threaded into respective reservoir and ram connector ports 63 and 64 formed in the wall of support spindle 32 and communticating with the axially extending passageway 62. It will be noted, by reference to FIG. 4, that the specific location of the connector ports 63 and 64 is such that they intersect passageway 62 intermediate the areas of the mounting blocks 58. Additional fluid passageways for completing the fluid communication between the conduits 25 and 26 and pump 31 include a plurality of transverse passages 65 and 66 which extend radially outward from the axial passageway 62 and terminate in respective annular ring collector grooves 67 and 68 extending around the periphery of the spindle 32. These radial passages 65, 66 and grooves 67, 68 are formed in the spindle 32 at a point coinciding with each of the respective mounting blocks 58. An interconnecting passage 69 is formed in each of the mounting blocks 58 in a position to cooperatively align with the respective collector grooves 67 and 68. These passages 69 also align with the respective receiving and discharge passages 45 and 46 in the end caps of the cylinder 41. Accordingly, hydraulic fluid may flow, in controlled relationship by valve means to be explained hereinafter, with respect to the conduits 25 and 26 through the passage 62 and into or out of the pump cylinder 41. Appropriate fluid seal elements 71 are provided in proper relationship around the spindle 32 at each side of the respective collector grooves 67 and 68. These seal elements 71 maintain a fluid-tight seal between the spindle 32 and the inner surface of the mounting blocks 58 and prevent fluid leakage throughout the relative swinging or swiveling of the pump about the spindle 32 while a continuously open fluid passageway is maintained as between the spindle and the pump. A fluid seal element 72 may also be provided at the interface between the end caps 43 and 44 of the pump and the respective mounting blocks 58.

The particularly advantageous structure of the pump apparatus, in accordance with this invention, will be readily apparent with reference to FIGS. 2 and 3 of the drawings. Specifically, with respect to FIG. 3, it will be seen that the pump apparatus may be swiveled about the support spindle 32 to the optimum position with respect to the operator of the crane. As clearly seen in FIG. 3, this swiveling movement of the pump comprises at least 180° so as to permit the crane operator to place the actuating handle 47 at the most comfortable position for operation of the pump 31. This swivel mounting arrangement thus enables the operator to stand at a convenient position with respect to the crane apparatus regardless of the angular position to which the crane may be moved on its support mounting 11. It will be noted that a typical crane mechanism such as that illustrated is pivotally mounted and may be swung through 360° about a vertical axis to a desired position. Since the crane was designed to be mounted on a transporting or other support structure, it will be apparent that a typical structure may present an obstacle to the operator being able to place himself in a convenient and safe operating position. Consequently, the swivel mounting of the pump results in a particularly advantageous constructural arrangement as the operator can readily swing the pump to a position where its actuating handle can be easily reached and operated. In addition to swiveling of the pump to place the handle at an optimum position, it will be noted that the interconnection of the conduits 25 and 26 with the spindle 32 further minimizes interference to swinging movement of the pump.

To obtain control over fluid flow as between the reservoir tank 22 and actuating ram 17, a manually operated, directional flow control valve is provided for selective operation by the crane operator to effect elevation or depression of the crane beam 13. In accordance with this invention, such a manually operated valve, designated generally by the numeral 75, is advantageously incorporated into the support spindle 32.

This valve 75 includes an axially movable valve element 76 which extends longitudinally through the elongated passage 62 and cooperates with a valve seat 77. For receipt of the valve element 76, the passageway 62 includes a relatively enlarged diameter portion 78 which can be best characterized as a valve chamber and which is greater in cross-sectional area than the lower portion of the cylindrical valve element. This valve chamber 78 opens at the upper end of the spindle 32 and terminates at its inner end in the valve seat 77 which comprises an angularly inclined surface interconnecting between the small diameter passageway 62 and that of the enlarged diameter valve chamber. It will be noted that the valve seat 77, as can be best seen in FIG. 4, is formed in the spindle at a point intermediate the reservoir and ram connector ports 63 and 64 for the conduits 25 and 26. Accordingly axial displacement of the valve element 76 to place a frusto-conical end face 79 thereof into sealing engagement with the inner circular edge 77*a* of the valve seat 77 will effectively close the passage 62 and prevent fluid flow therethrough between the connector ports 63 and 64. However, the diameter of this lower portion of the valve element is substantially less than that of the chamber 78 whereby hydraulic fluid may readily flow through the chamber between the connector port 63 and transverse passages 65. Normally the valve element 76 would be positioned as illustrated in FIG. 4 and actuation of the pump 31 would result in fluid flow from the reservoir tank 22 and through conduit 25, valve chamber 78, passages 65, 67 and 69 and into the receiving passage 45 of the pump. This fluid would then be displaced by the pump and out through the discharge passage 46 of the pump, through the interconnecting passages 69, 68 and 66 into the central axial passage 62 and then into the hydraulic ram 17 through conduit 26.

Once the apparatus has been operated to position the crane beam 13 at a desired elevation, it is then necessary that the operator be provided with means to selectively effect lowering or depression of the crane beam and this operational feature represents an important function of the valve 75. Accordingly, the valve element 76 which comprises an elongated cylindrical tube, is threaded into the valve chamber and thus may be selectively rotated to axially position the valve element's end face 79 either into or out of sealing engagement with the valve seat 77. For this purpose, the valve element 76 includes an enlarged upper end portion 80 that is formed with threads and engages mating threads formed on an interior surface of the chamber 78 at its upper end. This valve chamber opens at the upper end of the spindle 32 and terminates in a relatively enlarged diameter portion or sealing chamber 81. The valve element 76 extends axially outward through the sealing chamber and projects a distance above the upper end of the spindle 32 with this exterior end provided with a hand wheel 82 secured thereto for imparting rotative motion to the valve element. This handwheel 82 is of a diameter that may be easily gripped by the crane operator at this conveniently accessible location. The valve element is also provided with an "o"-ring-type sealing element 83 retained between two radially extending flanges 84 formed on the exterior of the valve element. This seal 83 forms a fluid tight seal between the valve element's enlarged upper end portion 80 and the side walls of the sealing chamber 81. Axial displacement of the valve element 76 may thus be affected without resulting in fluid flow out through the upper end of the spindle. To prevent inadvertent removal of the valve element 76 completely from the spindle, a retainer ring 85 is preferably secured in an annular recess 86 formed in the upper end face of the spindle 32. Thus it will be seen that the valve 75 functions primarily to effect control, as between raising or lowering of the crane beam, through either permitting fluid flow through the fluid displacing action of the pump 31, or a reverse flow from the ram 17 through conduit 26 and the axial passageway 62 to conduit 25 and return to the reservoir when the valve element face 79 and seat 77 are open and interconnect the ports 64 and 63. Since the speed at which the crane beam 13 can swing downwardly is directly related to the effective fluid flow area between the frusto-conical end face 79 and edge 77*a* of the valve seat, the valve 75 is specifically designed to provide the crane operator with capability for precise control. This objective is achieved through forming the enlarged portion with fine threads so that axial displacement can be accurately controlled through rotation of the handwheel 82 in conjunction with an optimum designed angle of the frusto-conical end face 79.

It will be noted that, in accordance with this invention, this valve also includes a fluid pressure relief valve to accommodate excessive pressures that may inadvertently build up in the system. These excessive pressures may result from attempting to pick up an excessive weight or from attempting to apply excessive force in positioning of mine timbers. Integral incorporation of the relief valve which is set to open at a predetermined pressure prevents operation of the crane in such a manner that injury could result to the operator or that a mine tunnel wall or roof could be damaged to the extent that the tunnel may collapse.

It is for this purpose that the valve element 76 is formed as a tubular structure having a relief valve chamber 87 formed in the upper end portion of the element. This valve chamber 87 which opens at the upper end of the valve element 76, communicates with a relatively smaller diameter passage 88 that extends axially downward through the valve element and opens at the lower end in association with the surrounding frusto-conical end face 79. It will be seen that fluid may also enter the relief valve passage 88 through its open end from the passage 62 of the spindle and flow upwardly. Restricting such upward fluid flow, however, is a ball check valve element 89 which normally interfits with a conical seat 90 formed at the lower end of the relief valve chamber 87 at its juncture with the passage 88. Normally biasing the ball check valve 89 into closing relationship with the seat 90 is a helical spring 91 extending axially through the chamber 87 and bearing against the ball check. The upper end of the spring 91 bears against an adjusting screw 92 which is turned in the relief valve chamber 87 to the desired position through threaded engagement with the cylindrical wall thereof. Axial adjustment of the screw 92 will thus alter the compressive force exerted by the spring 91 and enable adjustment to permit the ball check 89 to unseat in the event that fluid pressures greater than that normally expected to be encountered are experienced in the system.

With the screw 92 adjusted in accordance with the system pressure limitations, pressures in the actuating ram that exceed the predetermined maximum will result in unseating of the ball check valve element 89 and permit a flow of hydraulic fluid upwardly through the passage 86 and into the valve chamber 87. A pair of apertures 93 are formed in the wall of the valve element 76 and communicating with the lower end of the valve chamber 87 to permit fluid flow out of the valve chamber 87 and into the enlarged valve chamber 78. Thus a passageway is formed between the conduits 25 and 26 when excessive pressures are encountered even though the conical end face 79 of the valve element is seated in fluid-tight engagement with the valve seat 77. For completing the fluid sealing of the valve element 76, an end cap 94 is threaded into the uppermost end of the valve element and may be provided with an "o"-ring type seal 95.

It will be readily apparent from the foregoing detailed description of an illustrative embodiment thereof, that a novel and particularly advantageous pump and control valve apparatus has been provided in combination with a crane or hoist mechanism. The swivel mounting of the hand operated hydraulic pump on a vertically disposed support spindle with fluid conduits interconnecting the hydraulic fluid reservoir and actuating ram of the crane through internal passageways in the spindle effectively eliminates the conduits from interfering with swiveling of the pump. The pump being supported by the spindle on a side of the crane's base frame may thus be readily swung through an arc of at least 180° to place the actuating handle of the pump within the convenient reach of the crane operator. As a substantial further advantage of this invention, the effective elimination of exposed fluid conduits from the exterior of the crane materially reduces the likelihood of these conduits being damaged or ruptured in the severe usage environments that mine cranes are generally employed. Also, the integral incorporation of the combined direction flow control valve and relief valve in the support spindle further enhances the convenience of utilization and accessibility to the crane operator. The valve's operating handwheel is always in the same relative position to the crane where it may be readily located and reached by the operator.

Having thus described this invention, what is claimed is:

1. Fluid pump apparatus for a mine crane having a fluid operated ram and a fluid reservoir, the pump apparatus comprising a supporting framework attachable to the crane, an elongated support spindle mounted on said supporting framework and having an axially extending fluid passageway formed therein, a reservoir port and a ram port communicating with said passageway in axially spaced relationship to each other and connectable by respective fluid conduits with the reservoir and ram, manually operated fluid pump means mounted on said spindle for revolution about the axis thereof, said pump means including a fluid receiving passageway and a fluid discharge passageway coupled in fluid communicating relationship with the axial passageway of said spindle in axially spaced relationship to each other, and manually actuated fluid displacing means selectively operable to displace fluid from the receiving passageway and out of said discharge passageway, and manually operated, directional flow control valve means incorporated in said spindle for selectively controlling fluid flow with respect to the reservoir and the ram ports thereof and said pump means, said valve means including a valve seat formed in the spindle's axial passageway intermediate said reservoir and ram ports thereof and intermediate the coupling of said axial passageway with said fluid receiving and discharge passageways, and a manually actuated valve element selectively positionable into either closed relationship or open relationship with respect to said valve seat, said valve element when in the closed position effecting fluid flow from the reservoir through said pump means to the ram in response to operation of said pump means and, when in the open position, permitting fluid flow from the ram to the reservoir.

2. Fluid pump apparatus according to claim 1 and which includes fluid pressure relief valve means interposed in fluid communicating relationship between the reservoir and ram ports of said spindle, said relief valve means operable to permit fluid flow from said ram port to said reservoir port when the fluid pressure at said ram port exceeds a predetermined maximum.

3. Fluid pump apparatus according to claim 2 wherein said relief valve means is incoporated in the valve element of said directional flow control valve means.

4. Fluid pump apparatus according to claim 3 wherein said valve element comprises an elongated tube with an axially extending passage which is in fluid communicating relationship with the axial passageway of said spindle intermediate said valve seat and said ram port, and said relief valve means includes a valve chamber formed in the valve element tube and in fluid communicating relationship with the axial passage of the elongated tube, and a resiliently-biased check valve element disposed in said valve chamber in normally fluid flow blocking relationship with respect to the axial passage of the elongated tube.

5. Fluid pump apparatus according to claim 4 wherein said resiliently-biased check valve element is displaced into flow permitting relationship when fluid pressure in the axial passage of the elongated tube exceeds a predetermined value.

6. Fluid pump apparatus according to claim 4 wherein the elongated tube of said valve element has at least one aperture formed therein providing a fluid communicating passage between the relief valve chamber and the exterior of the valve element.

7. Fluid pump apparatus according to claim 4 wherein said resiliently-biased check valve element includes a selectively adjustable biasing element.

8. Fluid pump apparatus according to claim 1 wherein said spindle's axial passageway includes an enlarged portion forming a valve chamber and said valve seat is formed at an end of said valve chamber, said valve element disposed in said valve chamber for axial displacement therein and being of substantially less cross-sectional area than the valve chamber thereby forming a fluid passageway between opposed wall surfaces of the chamber and valve element.

9. Fluid pump apparatus according to claim 8 wherein said valve element is provided with a frusto-conical end face displaceable into sealing engagement with said valve seat.

10. Fluid pump apparatus according to claim 9 wherein said valve seat includes an inner circular edge which engages the frusto-conical end face of said valve element.

11. Fluid pump apparatus according to claim 8 wherein said valve element is coupled with said valve chamber by threaded engagement therewith whereby relative rotation of the valve element result in axial displacement thereof.

12. Fluid pump apparatus according to claim 11 wherein said valve element includes an end portion which projects a distance axially outward of said support spindle, said end portion provided with means facilitating gripping thereof by an operator to effect rotation.

13. Fluid pump apparatus according to claim 1 wherein said pump means is mounted on said support spindle by rotary fluid coupling means, and said spindle includes respective fluid passageways communicating between the axial passage therein at opposite sides of said valve seat with respective ones of the fluid receiving and discharge passageways of said pump means through said rotary fluid coupling means.

14. Fluid pump apparatus according to claim 13 wherein said rotary fluid coupling means includes a pair of mounting blocks journaled on said support spindle in axially spaced relationship, each of said mounting blocks having a fluid passageway connecting with a respective fluid or discharge passageway.

15. Fluid pump apparatus according to claim 14 wherein said mounting blocks are positioned on said spindle at opposite sides of said valve seat.

16. Fluid pump apparatus according to claim 1, including in combination, a mine crane having a base frame with longitudinal side members, said supporting framework mounted on one of said side members and mounting said support spindle thereon in vertically oriented and laterally outward spaced relationship thereto.

17. Fluid pump apparatus in the combination of claim 16, which includes respective fluid conduits connecting with the respective ram and reservoir and extending laterally outward from the base frame in mutually perpendicular relationship to the frame and said spindle, said conduits being connected in fluid coupled relationship with said spindle at respective ones of said reservoir and ram ports.

18. Fluid pump apparatus according to claim 17 wherein said fluid pump means includes an operating handle pivoted thereon for swinging movement in a vertical plane, and said pump means is revolvable through an angle of at least 180° to position said operating handle at extreme positions of extension either forwardly or rearwardly with respect to said base frame in parallel relationship to the longitudinal side members.

* * * * *